United States Patent [19]

Sudnishnikov et al.

[11] 4,078,619

[45] Mar. 14, 1978

[54] REVERSIBLE AIR-OPERATED APPARATUS OF THE PERCUSSIVE TYPE FOR DRIVING HOLES IN GROUND BY COMPACTING SAME

[76] Inventors: Boris Vasilievich Sudnishnikov, Krasny prospekt, 56, kv. 59; Konstantin Konstantinovich Tupitsyn, Krasny prospekt, 51, korpus 3, kv. 25; Sergei Konstantinovich Tupitsyn, ulitsa Zorge, 123, kv. 31; Veniamin Viktorovich Kamensky, ulitsa Derzhavina, 19, kv. 70; Alexandr Dmitrievich Kostylev, ulitsa Derzhavina, 19, kv. 44; Alexei Danilovich Terskov, ulitsa Bljukhera, 21, kv. 74, all of Novosibirsk, U.S.S.R.

[21] Appl. No.: 710,146

[22] Filed: Jul. 30, 1976

[51] Int. Cl.[2] ..... E21B 11/02

[52] U.S. Cl. ..... 175/19; 173/91

[58] Field of Search ..... 175/19; 173/91; 251/319, 297, 359, 214; 277/34, 34.3, 34.6; 166/333, 334

[56] References Cited

U.S. PATENT DOCUMENTS

| | | | |
|---|---|---|---|
| 1,988,397 | 1/1935 | Reed | 277/34.6 |
| 2,457,052 | 12/1948 | LeClair | 251/349 X |
| 3,137,483 | 6/1964 | Zinkiewicz | 175/19 |
| 3,651,874 | 3/1972 | Sudnishnikov et al. | 173/91 |
| 3,727,701 | 4/1973 | Sudnishnikov et al. | 175/19 X |
| 3,865,200 | 2/1975 | Schmidt | 175/19 |
| 3,952,813 | 4/1976 | Chepurnoi et al. | 173/91 |

*Primary Examiner*—Ernest R. Purser
*Assistant Examiner*—Richard E. Favreau
*Attorney, Agent, or Firm*—Lackenbach, Lilling & Siegel

[57] ABSTRACT

The apparatus consists of a hollow body wherein there is contained a striker which divides the space inside the body into a forward operating chamber and a rear exit chamber. The striker is provided with ports for admitting compressed air into the forward operating chamber and for allowing the emission of spent air from the chamber. The striker is also provided with an interior space, the rear end face of said striker being left open. Said hollow body includes passages and a pipe for placing said interior space of said striker in communication with a source of compressed, the pipe being positioned for longitudinal travel relative to the body. For holding fast the pipe in its extreme positions and for determining the direction of movement, which can be either forward or in reverse, the apparatus is provided with a means in the form of a member which exerts radial springy action, is of annular cross section and is disposed inside the body of the apparatus, one of the surfaces of the springy member being exposed to the pressure of compressed air and the other to the pressure of the surrounding medium.

10 Claims, 13 Drawing Figures

REVERSIBLE AIR-OPERATED APPARATUS OF THE PERCUSSIVE TYPE FOR DRIVING HOLES IN GROUND BY COMPACTING SAME

The present invention relates to air-operated apparatus of the percussive type for driving holes in the ground, and more specifically to reversible air-operated apparatus of the percussive type for driving holes in the ground by compacting same. The apparatus disclosed may be used in laying pipelines, power and communication cables, etc. by the trenchless method.

There are known in the art reversible air-operated apparatus of the percussive type for driving holes in the ground by compacting same (cf., for example, FRG Pat. No. 1,634,417 of the Federal Republic of Germany).

The known apparatus has a hollow cylindrical body, which is tapering in the direction of driving the hole, wherein there is contained a striker with a provision for longitudinal travel is, said striker being provided with an interior space, being open at the rear end face and having side ports. The striker divides the space inside the body into a forward operating chamber and a rear exit chamber, and reciprocates due to the pressure of compressed air striking against the body. The apparatus is provided with an air-distributing pipe built into the body and so arranged with its forward portion inside the space in the striker that the side ports of the striker are alternately closed and opened by said forward portion of the pipe when the striker moves back and forth, thus placing the forward operating chamber in communication with either the space in the striker or the rear exit chamber. For reversing the apparatus, the forward portion of the pipe is made so that it is capable of displacing relative to the body into either of the extreme positions, i.e., forward or back, a threaded connection between the pipe and body providing for said longitudinal travel. The requisite displacement of the pipe is obtained in this case due to the rotation of a flexible air hose attached to the pipe. When the apparatus is in operation, the friction between the male and female threads holds fast the pipe in the given position.

In another embodiment of the invention disclosed in the above Patent, the pipe is made up of several members. The forward portion consists of a sleeve slipped on the tubular rear portion of the pipe secured immovably relative to the body. Interposed between the sleeve and the rear portion of the pipe is a spring which sets the sleeve into the extreme foremost position wherein the sleeve is held fast by a ball resting in a hole provided in the rear portion of the pipe. The ball is pressed against the sleeve by the outward tapered surface of a spring-loaded tube accommodated inside the rear portion of the pipe. For setting the sleeve of the pipe into either of the extreme positions as required, it is sufficient to release the ball by moving rearward, with the aid of the hose, the spring-loaded tube accommodated inside the rear portion of the pipe. Once released, the ball does not prevent the sleeve from moving so that the compressed air admitted into the apparatus causes the sleeve to travel backwards as far as it will go and to stay there until the flow of air into the apparatus is cut off. The sleeve is returned to its forward position due to the action of the spring when no compressed air is admitted into the apparatus.

A disadvantage of the apparatus disclosed in the FRG Pat. No. 1,634,417 is low reliability of the way the pipe is being held fast in its extreme positions. When use is made of the threaded joint between the pipe and body as envisaged in the first embodiment of the invention, it is possible that the pipe will move on its own accord if the air hose is turned by accident, as this may be the case in practice, for the friction between the male and female threads may be too low to hold the pipe in place when the striker strikes against the body. Moreover, the pipe may fail to be moved by the air hose which may lack rigidity to overcome the resistance in the threaded joint between the pipe and body if said joint is clogged up. In the other embodiment of the invention disclosed in said Patent, the snap ball may become released due to an accidental pull on the hose during operation so that the sleeve will move backwards under the pressure of air, causing the apparatus to change the working direction from "forward" to "back." If the apparatus is being reversed, an accidental interruption of the flow of compressed air into the apparatus, no matter how short this interruption may be, will change the working direction of the apparatus to "forward," because in this case the sleeve will be moved by the spring into the foremost position and locked there by means of the ball. Summing up, because of the low reliability of the way the pipe is held fast in the requisite position relative to the body inherent in the apparatus disclosed in said Patent are involuntary changes of the direction in which the apparatus is set to operate, said changes occuring due to the turning or pulling of the air hose by accident or due to the interruption of the flow of compressed air into the apparatus.

Said disadvantages are eliminated in an apparatus disclosed in FRG Pat. No. 2,340,751 also granted by the Federal Republic of Germany. Said apparatus features a hollow cylindrical body, which is tapered in the forward direction and is in the form of a pike at the front while the rear portion of the body is closed by a flange rigidly attached thereto. Accommodated inside the body is a reciprocating striker the fore-and-aft strokes whereof being limited by the front part of the body at one end and by the flange rigidly attached to the rear of the body at the other end. Built into the rear of the body, i.e., into the flange, with a provision for rotation and longitudinal displacement relative to the body is an air-distributing pipe which is provided with stops serving to limit the amount of its longitudinal displacement; also disposed in the flange is a means for preventing the rotation of the pipe relative to the body. The striker divides the space inside the body into two chambers, a forward operating chamber and a rear exit chamber. Said rear exit chamber is connected to a surrounding medium through longitudinal passages in the flange whereas the striker has an interior space, is open at the rear end face and has ports at the sides. The forward portion of the air-distributing pipe is arranged in the space inside the striker so that it can either close the side ports in the striker or open them depending on the position of the striker. The stops limiting the amount of longitudinal displacement of the pipe are given the form of projections on the side surface of the pipe. Said projections can enter longitudinal grooves provided in the flange, if the projections are placed opposite the grooves, thereby enabling the pipe to move longitudinally. By turning the pipe through a certain angle it can be placed into a position wherein the projections on the pipe fail to align with the longitudinal grooves in the flange and, as a result, no longitudinal displacement of the pipe relative to the body is possible. When placed in any of such positions, the pipe is locked against rotation by means of a ball with a control device built into the flange. The control device is a spring-loaded pin in contact with the ball with one of its ends while attached to the other end there is a wire used to control the operation of the ball from a distance. When the pipe is placed into its foremost position, the apparatus is set to operate forward. This implies that the striker, reciprocating under the pressure of compressed air, strikes against the forward part of the body, i.e., against the pike. When the pipe is placed into its rearmost position, the apparatus is set to operate backward in which case the striker strikes against the rear part of the body, i.e. the flange, while reciprocating.

The main disadvantage of the apparatus disclosed in the FRG Pat. No. 2,340,751 is the complicated procedure of changing over from one working direction to the other. For reversing the apparatus, it is necessary to cut off the delivery of compressed air into the apparatus, to pull the wire so as to release the ball and then, holding the wire taut, to turn the pipe through a certain angle by turning the air hose. Next, the pipe is shifted into its rearmost position by pulling the hose, turned through the requisite angle by turning the air hose and only then the wire is released of the tension applied thereto so as to lock the pipe against rotation. The procedure of changing over from working in reverse to working forward is the same only in the reversed order of events. However, when the apparatus operates under the ground, said changing over poses extreme difficulties, if being possible at all, for it is hardly possible to shift the pipe into its foremost position as required by applying a force to the hose which is too flexible to transmit same to the pipe.

It is the object of the present invention to provide a reversible air-operated apparatus of the percussive type for driving holes in the ground by compacting same which, featuring a reliable way of holding fast the pipe in its extreme positions relative to the body, poses no manufacturing problems and is more convenient in operation than all known apparatus of the same type.

Said and other objects are attained by a reversible air-operated apparatus of the percussive type for driving holes in the ground by compacting same which incorporates a hollow cylindrical body, which is tapered in the direction of driving the hole. Contained in the body is a striker dividing the space inside the body into at least one operating chamber and one exit chamber of variable volumes. The striker reciprocates under the action of compressed air admitted into the apparatus and, moving so, strikes against the body. The striker is provided with at least one side port for admitting compressed air into the forward operating chamber and for allowing the emission of spent air from said chamber. The striker is also provided with an interior space and is left open at the rear end face. The apparatus is provided with an air-distributing pipe which is accommodated inside the body, connected to a line supplying compressed air, provided with at least one longitudinal passage and disposed so that the forward portion of the pipe is contained in the space inside the striker, thus connecting same to the source of compressed air. The rear portion is built into the rear of the body with a provision for longitudinal travel relative to the body between its foremost and rearmost positions. The rear part of the body is provided with passages connecting the exit chamber to the surrounding medium. The apparatus is provided with a means for holding fast the pipe in its extreme positions relative to the body. In accordance with the invention, the means of holding fast the pipe in its extreme positions consists of at least one member which exerts a radial springy action, is of annular cross section and is so disposed inside the body of the apparatus that the outward side surface of said member faces the inward side surface of the body and the inward side surface faces the longitudinal axis of the apparatus, one of said surfaces of the springy member being exposed to the pressure of compressed air and the other to the pressure of surrounding medium.

By virtue of the present invention there is provided a reversible air-operated apparatus of the percussive type for driving holes in the ground by compacting same which, featuring a reliable way of holding fast the pipe in its extreme positions relative to the body, poses no manufacturing problems and is more convenient in operation than all known apparatus of the same type.

It is preferred that a sleeve with holes piercing its walls and, which is immovably attached to the body, is provided inside the striker, said striker being interposed between said body and the forward portion of the air-distributing pipe, said pipe being so arranged in said sleeve that the holes in the sleeve are closed by said pipe when it is placed into its foremost position and are opened when the pipe is shifted into the rearmost position. A plan like this is conducive to reducing the distance the air-distributing pipe is bound to cover in order to set the apparatus to operate in reverse.

It is also preferred that the member exerting radial springy action is made in the form of an elastic hose attached to the air-distributing pipe so that the bore of said hose forms a part of the longitudinal passage of the air-distributing pipe. This arrangement allows the employment of the air hose as the member exerting radial springy action.

It is also preferred that grooves running obliquely to the longitudinal axis of the apparatus are provided in the inward side surface of the body and in the outward side surface of the springy member facing said inward surface or, alternatively, a layer of material displaying high friction is applied to each of said surfaces to improve the reliability of the way the air-distributing pipe is held fast in its extreme positions relative to the body.

It is preferable to provide inserts between the body and the elastic hose so that said inserts deform the hose in the transverse direction, thus requiring less stringent requirements for the manufacture of the elastic hose than ever before.

It is preferable to interpose between the springy member and the body a sleeve attached to the air-distributing pipe and provided with longitudinal slots as well as with external projections and to provide inside the body recesses aligning with said projections so that said projections fit into said recesses when compressed air is being admitted into the air-distributing pipe. As a result, said pipe is held fast in the given position relative to the body, and the elastic hose is protected from wear.

It is also preferable to provide projections on the outward surface of the springy member and to provide in the inward surface of the rear part of the body recesses which are disposed opposite said projections so that said projections enter said recesses when compressed air is being admitted into the pipe. This adds to the strength of the joint between the pipe and body so that the pipe is held fast in the given position relative to the body in a more reliable way.

It is also preferable that the member exerting radial springy action be made in the form of elastic rings and the air-distributing pipe be provided with external grooves wherein said elastic rings are accommodated, the pipe being pierced with holes placing the grooves in communication with the longitudinal passage of the pipe. This solution offers the prospect of using prefabricated standard parts as the springy member.

Finally, it be preferred that the springy member is made in the form of an elastic cup attached to the body with its outward surface while the inward surface of said cup contacts the outward surface of the rear portion of the air-distributing pipe, the space enclosed by said cup, the body, the sleeve, which is immovably attached to the body, and by the pipe being placed in communication with the longitudinal passage in said pipe through a hole with which the pipe is provided with, so that, when compressed air is admitted into the apparatus, the pipe is held fast in its extreme positions relative to the body by said cup pressed against the pipe. An arrangement like this simplifies the design of the apparatus.

The present invention will be best understood from the following detailed description of a preferred embodiment of the invention when this description is read in conjunction with the accompanying drawings in which.

Figure 13:
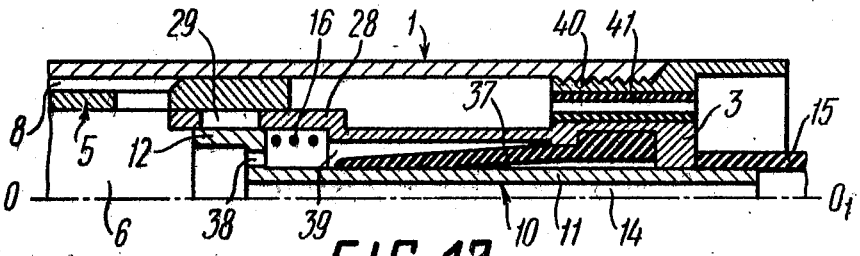

FIG. 13 is a sectional elevational view of the rear part of the apparatus wherein the member exerting radial springy action is immovably attached to the body and there is provided for admitting compressed air into the space formed by the body, the air-distributing pipe, the springy member and the sleeve immovably attached to the body a hole in the end face of said pipe, said hole communicating with the longitudinal passage in said pipe.

The apparatus is built symmetrically about its longitudinal axis $0—0_1$.

Figure 1:
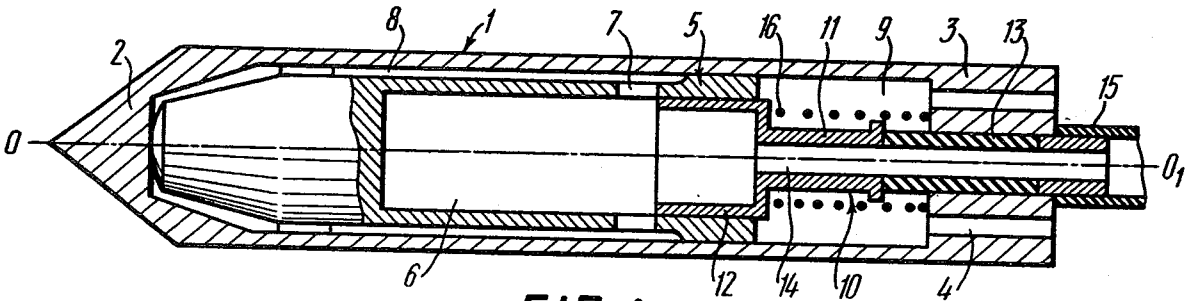
FIG. 1 is a sectional elevational view of the reversible air-operated apparatus, according to the invention, of the percussive type for driving holes in the ground by compacting same.
Figure 2:
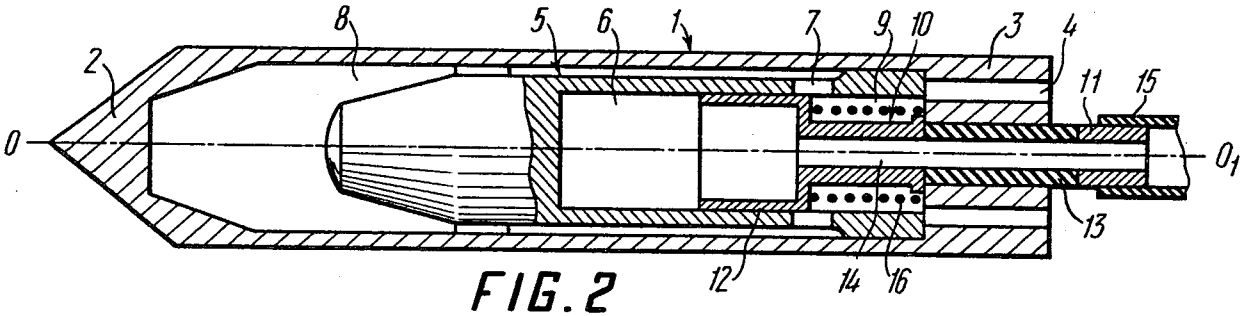
FIG. 2 is a view similar to FIG. 1 illustrating the apparatus with the air-distributing pipe set into its rearmost position so as to operate in reverse.

The apparatus shown in FIGS. 1 and 2 consists of a hollow body 1 which has a forward pointed part 2 and a rear part 3 featuring an end face of extra thickness wherein there are provided longitudinal passages 4 placing the the interior of the body 1 in communication with the surrounding medium. Disposed inside the body with a provision for longitudinal travel is a striker 5 with an interior space 6 and which is open at the rear end face and which has side ports 7. The striker divides the space inside the body into two chambers — a forward operating chamber 8 and a rear exit chamber 9 — and reciprocates inside the body due to the action of compressed air striking against the body in the course of said displacements. Serving the purpose of admitting compressed air into the forward chamber and of emitting spent air from leaving said chamber into surrounding medium, there is provided in the apparatus an air-distributing pipe 10. The rear portion 11 of said pipe 10 is built into the rear part 3 of the body 1 with a provision for longitudinal travel relative to the body between the foremost and rearmost positions, and the forward portion 12 of the pipe extends into the space 6 inside the striker.

For holding fast the air-distributing pipe in its extreme positions, the rear portion of said pipe is provided with a member exerting radial springy action. Said member is made in the form of an elastic hose 13 attached to the pipe so that the bore of said hose forms a portion of a longitudinal passage 14 in the pipe which communicates with a source of compressed air (not shown) wherefrom air is supplied over a flexible line 15 attached to the rear portion of the pipe. By benefit of this arrangement, the space 6 in the striker is always connected to a source of compressed air. A compression spring 16 placed between the forward portion of the air-distributing pipe and the rear part of the body serves to set said pipe in its foremost position.

When the apparatus is set to operate forward, compressed air is admitted into the space 6 of the striker from the air line 15 through the longitudinal passage 14 of the air-distributing pipe. The air, exerting its action on the elastic hose 13, causes its outward side surface to come into contact with the inward side surface of the rear part 3 of the body so as to hold fast the air-distributing pipe in its foremost position, as indicated in FIG. 1. When the striker is in its foremost position, the ports 7 are not closed by the forward portion 12 of the air-distributing pipe as shown in FIG. 1 and compressed air enters the forward operating chamber 8 from the space 6 through said ports 7. Since the area of the striker whereto the pressure of the air in the chamber 8 is applied is larger than the area of the striker which is subject to the pressure in the space 6 of the striker, said striker is urged to move towards the rear part 3 of the body. As it progresses in said direction, the forward portion 12 of the pipe closes the ports 7 and the striker continues its travel due to inertia and the expansion of compressed air in the forward operating chamber 8. Next, the ports 7 of the striker become open again, placing the forward operating chamber 8 in communication with the rear exit chamber 9. Said chamber, in its turn, is connected to the surrounding medium through the passages 4 in the rear part of the body, enabling spent air to escape from the chamber 8 into the surrounding medium. After that, the striker stops due to the pressure of compressed air in the space 6 and starts its travel towards the forward part 2 of the body. In the course of the progress of the striker, the ports 7 therein are again closed by the forward portion 12 of the pipe to be opened at a later stage so that the forward operating chamber is again filled with compressed air. Once compressed air is admitted into the chamber 8, the striker reaches the forward part 2 of the body 1, strikes against said part and starts moving rearward. Said cycle is regularly repeated and the body, being struck by the striker, is caused to drive the hole. The reactions of those forces which impart motion to the striker when the apparatus is in operation are taken up by the body, yet they fail to bring about any displacement of the body in the opposite direction because they are by far smaller than the frictional forces coming into play between the walls of the apparatus and the walls of the hole being driven.

The procedure of setting the apparatus to operate in reverse is as follows. The feed of compressed air into the apparatus is cut off and, consequently, the air-distributing pipe is released of the grip of the member 13, because the member 13 exerting radial springy action decreases in cross section and fails to produce as much friction as is required to take hold of the pipe. After that, the pipe 10 is shifted in its rearmost position shown in FIG. 2 by pulling the air line 15, and compressed air is admitted into the apparatus while the air line is being held taut. When shifted into its new position, the pipe is again held fast in the same way as when set into its foremost position, i.e., the springy member (elastic hose) 13 expands due to the pressure of compressed air so that its outward side surface is pressed against the inward side surface of the rear part 3 of the body and the pipe is consequently held fast. Once the pipe has been set into its new (rearmost) position, compressed air is admitted into the forward operating chamber 8 and spent air is released from said chamber in the same way as occurs when the pipe is in the foremost position, and the striker 5 also reciprocates inside the body. Yet, when the pipe 10 is set into this new position, compressed air is admitted into the forward operating chamber 8 somewhat earlier in the cycle than was the case when the pipe was in its foremost position and, owing to that, the striker stops short of the forward part 2 of the body without striking same. When the striker is on the backstroke, being acted upon by the pressure of compressed air in the forward operating chamber 8, spent air is released from said chamber somewhat later in the cycle than is the case when the pipe was in its foremost position and, owing to that, the pressure in the space 6 is too low to stop the striker which consequently reaches the rear part 3 of the body and strikes against same. Yielding to the strikes the striker delivers against the rear part of the body, the apparatus returns along the hole driven and reaches its head.

For changing the direction of travel from back to forward, it is necessary to stop the flow of compressed air into the apparatus. As a result, the springy member 13 releases its hold on the pipe which is returned, due to the action of the spring 16, into its foremost position wherein the apparatus operates forward.

Figure 3:
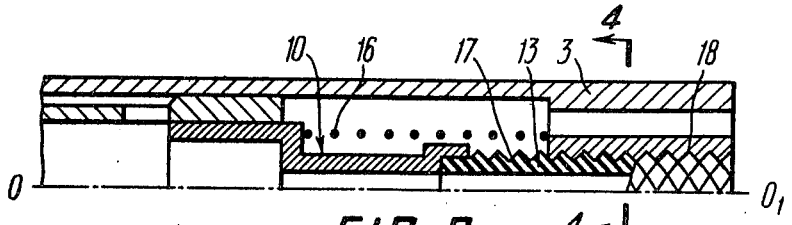
FIG. 3 is a sectional elevational view illustrating the apparatus rear part wherein the member exerting radial springy action and the contiguous surface of the body are provided with grooves running obliquely to the longitudinal axis $0\text{-}0_1$ of the apparatus.
Figure 4:
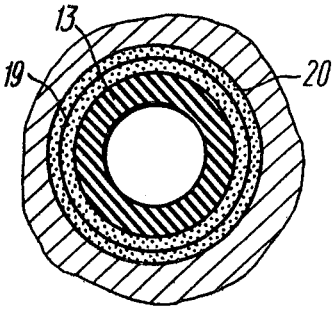
FIG. 4 is essentially a cross-sectional view taken along the line 4—4 of FIG. 3 on an enlarged scale, but showing another embodiment wherein layers of high friction material are applied to the springy members and the body.

The rear part of the apparatus illustrated in FIG. 3 differs from the rear part of FIGS. 1 and 2 in that grooves 17 and 18 running obliquely to the longitudinal axis of the apparatus are provided in the outward side surface of the rubber hose 13 and in the contiguous surface of the body of the apparatus. This adds to the forces of cohesion between the pipe and body so as to improve the reliability of the way the pipe is being held fast. Serving the same purpose, as this can be noted from FIG. 4, are layers 19 and 20 of a high-friction material which are applied to the contiguous surfaces of the rubber hose 13 and the body.

Figure 5:
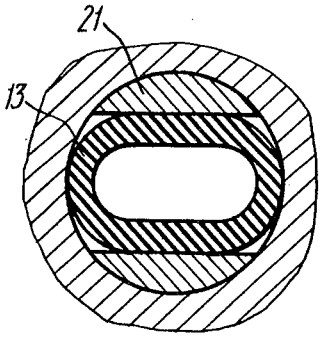
FIG. 5 is essentially a cross-sectional view taken along the line 4—4 of FIG. 3, but illustrating another embodiment wherein inserts are provided between the springy member and body, said inserts deforming the springy member.

Referring to FIG. 5, additional members in the form of inserts 21 which deform the hose 13 in a transverse direction are interposed between the hose 13 and the body of the apparatus The recourse to inserts allows less stringent requirements for the manufacture of the hose 13, for the adequate contact required to hold fast the pipe can be assured whatever the degree of change in the diameter of the hose.

When compressed air is admitted into the apparatus illustrated in FIG. 3, the rubber hose 13 expands under the pressure so that its outward surface with the grooves 17 is pressed against the contiguous surface of the body with the grooves 18. The grooves 17 and 18 increase the cohesive force and render the way the pipe is being held fast in its extreme positions more reliable. The hose 13 shown in FIG. 4 operates on a similar principle. In this case, the holding fast of the pipe in a reliable way is obtained by virtue of the layers 19 and 20; change high-friction material which increase the frictional forces between the pipe and contiguous inward surface of the body of the apparatus. The hose 13 of FIG. 5 is pressed not to the body directly, when compressed air is being admitted into the apparatus, but to the inserts 21 interposed between said hose and the body, this action of the hose holding fast the pipe relative to the body. As far as other aspects of operation are concerned the apparatus illustrated in FIGS. 3, 4 and 5 do not differ in principle from the apparatus shown in FIGS. 1 and 2.

Figure 6:
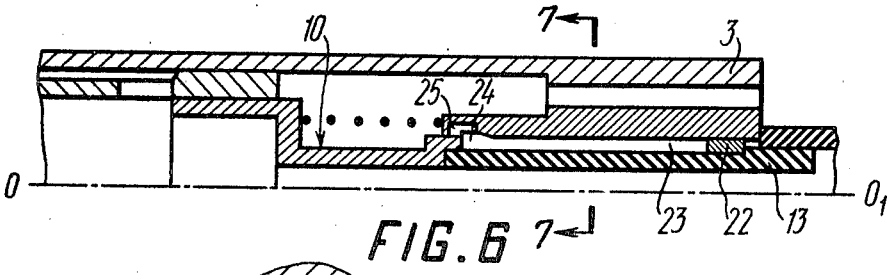
FIG. 6 is cross-sectional view taken along the elevational view of the rear part of the apparatus in an embodiment wherein there is incorporated a sleeve with longitudinal slots and external projections which serve to hold fast the air-distributing pipe.
Figure 7:
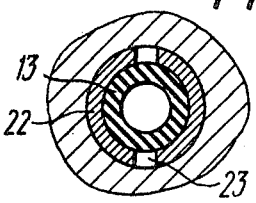
FIG. 7 is a section on line 7—7 of FIG. 6.

Depicted in FIGS. 6 and 7 is the rear part of the apparatus of another embodiment. Compared with the rear part of the apparatus shown in FIGS. 1, 2 and 3, a new component is introduced thereinto in the form of a sleeve 22 attached to the air-distributing pipe and provided with longitudinal slots 23 as well as with external projections 24 on the sides, said projections being disposed opposite recesses 25 provided in the rear part of the body of the apparatus. When the apparatus is in operation, the elastic hose 13 expands under the pressure of compressed air and exerts a force on the projections 24 which enter the recesses 25 in the body, thus holding fast the air-distributing pipe in a given position relative to the body. Other aspects of the operation of the apparatus are the same as those in FIGS. 1 and 2.

Figure 8:
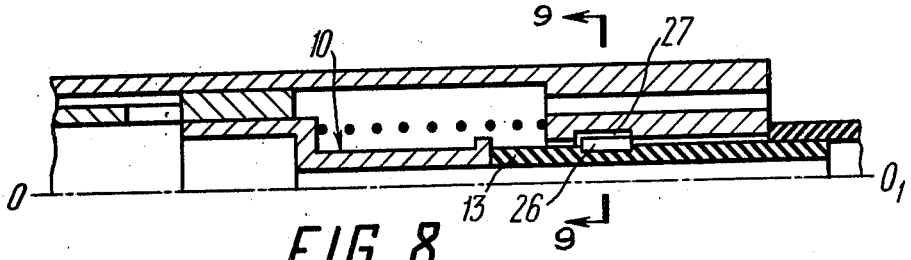
FIG. 8 is a sectional elevational view of the rear part of the apparatus in an embodiment with projections provided on the springy member which improve the way in which the air-distributing pipe is held fast in the body.
Figure 9:
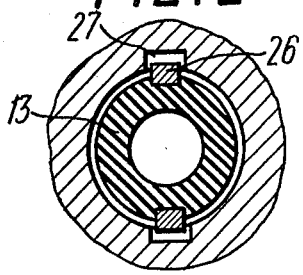
FIG. 9 is a cross-sectional view taken along the line 9—9 of FIG. 8.

FIGS. 8 and 9 illustrate another embodiment of the rear part of the apparatus which differs from the rear portion of the apparatus shown in FIGS. 1 and 2 in that there are projections 26 attached to the elastic hose 13 and disposed opposite recesses 27 in the body when the air-distributing pipe is set to either of its extreme positions relative to the body. Following the admission of compressed air, the elastic hose 13 expands so as to be pressed against the contiguous surface of the body of the apparatus, thereby holding fast said pipe. The projections 26 provided on said hose enter the recesses 27 in the body, adding to the reliability of the link up between the pipe and body. Otherwise, the apparatus operates according to the same principles as the apparatus shown in FIGS. 1 and 2.

Figure 10:
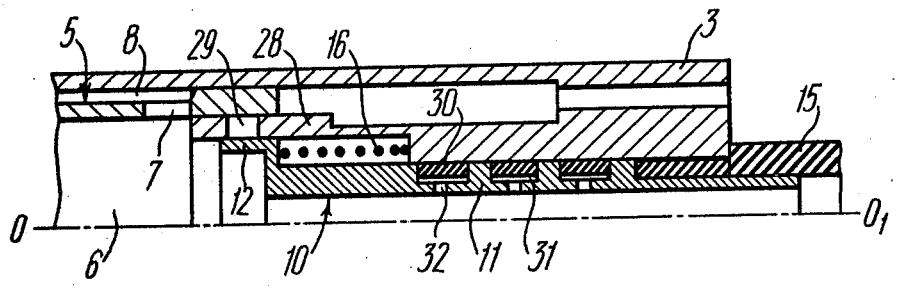
FIG. 10 is a sectional elevational view of the rear part of the apparatus in an embodiment featuring a sleeve with side holes rigidly attached to the body while the springy member is made in the form of elastic rings accommodated in grooves with which the air-distributing pipe is provided.

FIG. 10 illustrates another embodiment of the rear part of the apparatus which differs from the rear part shown in FIGS. 1 and 2 in that there is a new component in the form of a sleeve 28 with side holes 29 which is immovably attached to the body and is disposed in the space 6 of the striker 5 between said striker and the forward portion 12 of the air-distributing pipe. The side holes 29 are closed by the forward portion 12 of the pipe when said pipe is shifted inside the sleeve 28 into its foremost position. Said holes remain open when said pipe is set into its rearmost position. For holding fast the pipe in its extreme positions relative to the body, the springy member is made, for example, in the form of rubber rings 30 accommodated in grooves 31 provided in the rear portion 11 of said pipe. The grooves 31 are permanently connected to the longitudinal passage 14 of the pipe, being admitted thereinto compressed air, by means of holes 32 provided in said pipe.

The apparatus shown in FIG. 10 operates forward when the air-distributing pipe 10 is set into its foremost position, i.e., when the holes 29 in the sleeve 28 are closed by the forward portion 12 of said pipe. This is in contrast to the apparatus shown in FIG. 1, wherein the ports 7 of the striker 5 are closed and opened, when said striker reciprocates under the pressure of compressed air applied to the forward operating chamber 8 and the space 6 in the striker, by the sleeve 28 interposed between the striker 5 and the air-distributing pipe 10 and not by the forward portion 12 of said pipe. In addition, said pipe is held fast by elastic rings 30 which, while expanding under the pressure of compressed air entering the grooves 31 through the holes 32, are pressed by their outward side surface to the contiguous surface of the body, thus giving rise to friction between the body and the rings 30 fitted on the pipe which is sufficiently high to hold fast the pipe.

For reversing the apparatus shown in FIG. 10, it is necessary to cut off the flow of compressed air, to shift the air-distributing pipe into its rearmost position by pulling the air line 15 and then to admit compressed air again into the apparatus. When the air-distributing pipe is in its new (rearmost) position, the holes 29 in the sleeve 28 are open so that compressed air is admitted into the forward operating chamber through said holes in said sleeve when the striker is on the forward stroke or, in other words, the induction takes place in this case somewhat earlier in the cycle than when the air-distributing pipe is in its foremost position. Because of an early induction of compressed air into the forward operating chamber 8, the air pressure applied to said chamber stops the striker, which is on the forward stroke, short of the front part 2 of the body without striking same and causes the striker to reverse its stroke. When the striker is on the backstroke, the induction of compressed air into the forward operating chamber 8 is interrupted somewhat later in the cycle than is the case when the air-distributing pipe is in the foremost position. Owing to that, by the time spent air leaves the forward operating chamber, the kinetic energy of the striker is much higher than the kinetic energy the striker displays in moving when the air-distributing pipe is in the foremost position. Under the circumstances like this, it appears that pressure of compressed air applied to the space 6 is not sufficiently high to bring the striker to a strikeless halt, and the striker ends its backstroke by striking against the rear part 3 of the body of the apparatus.

Figure 11:
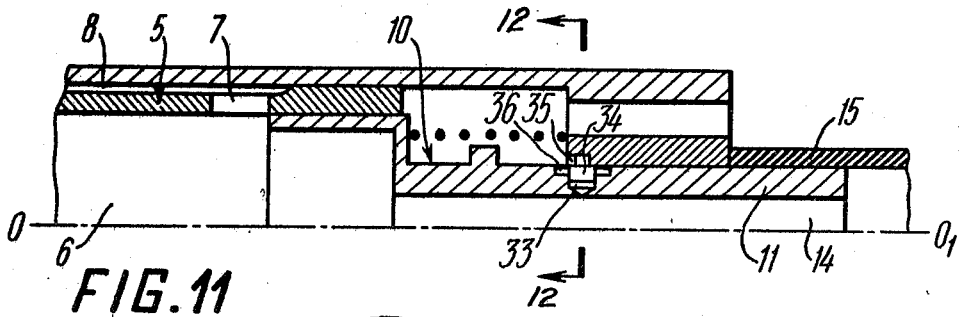
FIG. 11 is a sectional elevational view of the rear part of the apparatus with pins disposed in the through holes of the air-distributing pipe and embraced by the springy member.
Figure 12:
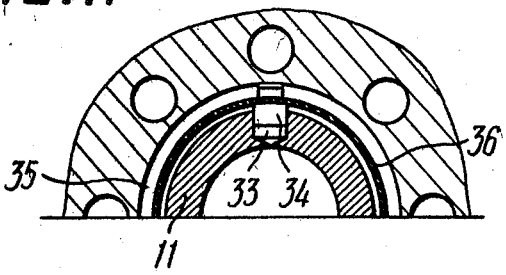
FIG. 12 is a cross-sectional view taken along the line 12—12 of FIG. 11.

It can be noted that the rear part of the apparatus illustrated in FIGS. 11 and 12 differs from that of the apparatus shown in FIGS. 1 and 2 in that provided in the wall of the rear portion 11 of the air-distributing pipe are through holes 33, wherein there are accomodated pins 34 which are located opposite annular recesses 35 provided in the rear part of the body. The springy member made in the form of an elastic (e.g., rubber) ring 36 embraces all the pins 34 so as to keep them flush with the edges of the holes 33. In said embodiment, the air-distributing pipe is held fast by the pins 34 which, by overcoming the resistance of the elastic ring 36, yield to the pressure of air in the passage 14 of said pipe and extend from the holes 33 so as to enter the annular recesses 35 in the body when compressed air is being admitted into the apparatus. When the flow of compressed air into the apparatus is interrupted, the pins 34 are forced by the action of the elastic ring 36 out of the annular recesses 35, and due to that the air-distributing pipe is free to shift rearwards so as to set the apparatus to operate in reverse. In other respects, the operation of said apparatus does not differ from the operation of the apparatus shown in FIGS. 1 and 2, i.e., compressed air is admitted into the forward operating chamber 8 and spent air leaving said chamber is disposed of when the striker is on the move exactly in the same way as in the apparatus of FIGS. 1 and 2.

The rear part of the apparatus shown in FIG. 13 differs from that of the apparatus represented in FIG. 10 by the fact that the member exerting radial springy member is in the form of an elastic cup 37 made, for example, of rubber which is immovably attached to the body and embraces the outward surface of the rear portion 11 of the air-distributing pipe 10. In addition, there is a hole 38 in the forward end face of the pipe wherethrough a space 39 enclosed by said pipe, by the outward surface of the cup 37, by the sleeve 28 and by the body is connected to the source of compressed air. Other details of the rear part 3 of the apparatus shown in FIG. 13 are a nut 40 screwed into the body and a shock absorber 41 attached to said nut. The sleeve is attached to the body not directly but by means of the shock absorber 41. The operating principle of the apparatus shown in FIG. 13 is the same as that of the apparatus illustrated in FIG. 10. The only difference is in the way the air-distributing pipe is being held fast. This is accomplished with the aid of the elastic cup 37 which is immovably attached relative to the body and is pressed to the air-distributing pipe by the pressure of air admitted into the space 39 through the hole 38 in said pipe so as to hold fast same in the given position relative to a body.

What is claimed is:

1. A reversible air-operated apparatus of the percussive type for driving holes in the ground by compacting same, which is connected to a source of compressed air and incorporates a hollow cylindrical body tapered in the direction of driving the hole, comprising: a striker which divides the space inside said body into at least one operating chamber and at least one exit chamber of variable volumes, said striker reciprocating due to the pressure of compressed air admitted into the apparatus, the striker striking against the body of the apparatus in the course of its travel, said striker being provided with at least one side port for admitting compressed air into said operating chamber and for allowing emission of spent air from this chamber, and said striker being provided with an interior space, the striker being left open at a rear end face; an air-distributing pipe which is connected to a compressed air line, said pipe being provided with at least one longitudinal passage communicating with the source of compressed air, and said pipe being disposed so that a forward portion of said pipe is contained in the space inside said striker, thereby placing said space in communication with the source of compressed air, a rear portion of said pipe being built into a rear part of said body of the apparatus with a provision for longitudinal travel relative to the body between foremost and rearmost positions of the pipe, the rear part of said body being provided with longitudinal passages which place said exit chambers in communication with a surrounding medium; a means of holding fast said pipe in its extreme positions relative to said body consisting of at least one member which exerts radial springy action, said member being of annular cross section, and said member being disposed so that the outward said surface of said member faces the inward side surface of said body and the inward side surface of said member faces a longitudinal axis of the apparatus, one of said surfaces of said member being exposed to the pressure of compressed air and the other to the pressure of the surrounding medium.

2. A reversible air-operated apparatus of the percussive type for driving holes in the ground by compacting same, which is connected to a source of compressed air and incorporates a hollow cylindrical body tapered in the direction of driving the hole, comprising: a striker which divides the space inside said body into at least one operating chamber and at least one exit chamber of variable volumes, said striker reciprocating due to the pressure of compressed air admitted into said apparatus, the striker striking against said body in the course of its travel, said striker being provided with at least one side port for admitting compressed air into said operating chamber and for allowing emission of spent air from this chamber, and said striker being provided with an interior space, the striker being left open at a rear end face; an air-distributing pipe which is connected to a compressed air line, said pipe being provided with at least one longitudinal passage communicating with the source of compressed air, and said pipe being disposed so that a forward portion of said pipe is contained in the space inside said striker, thereby placing said space in communication with the source of compressed air, a rear portion of said pipe being built into a rear part of said body of the apparatus with a provision for longitudinal travel relative to the body between foremost and rearmost positions of the pipe, the rear part of said body being provided with longitudinal passages which place said exit chamber in communication with a surrounding medium; a means of holding fast said pipe in its extreme positions relative to said body consisting of at least one elastic hose attached to said pipe so that the bore of said hose forms a part of the longitudinal passage in said pipe, an outward side surface of said hose facing the inward side surface of said body and an inward side surface of said hose facing the longitudinal axis of said apparatus, the inward surface of said elastic hose being exposed to the pressure of compressed air and the outward surface to the pressure of the surrounding medium.

3. An apparatus as claimed in claim 2, wherein grooves running obliquely to the longitudinal axis of said apparatus are provided on the inward side surface of said body and on the outward side surface of said elastic hose facing said inward surface.

4. An apparatus as claimed in claim 2, wherein a layer of high friction material is applied to the inward side surface of said body and another such layer is applied to the outward side surface of said elastic hose facing said inward side surface.

5. An apparatus as claimed in claim 2, wherein inserts are provided between said body and said elastic hose so that said inserts deform said hose in the transverse direction.

6. An apparatus as claimed in claim 2, wherein projections are formed on the outward side surface of said elastic hose and recesses are provided on the inward side surface of the rear part of said body, said recesses being disposed opposite said projections so that said projections fit into said recesses when compressed air is being admitted into said pipe and, consequently, said hose is expanding; whereby the manner in which said pipe is held fast in a given position relative to the body is made more reliable.

7. An apparatus as claimed in claim 2, wherein a sleeve attached to said pipe and provided with longitudinal slots and external projections is interposed between said elastic hose and said body, said body having recesses aligned with said projections so that said projections fit into said recesses when compressed air is being admitted into said pipe, and, consequently, said hose is expanding; whereby said pipe is held fast in a given position relative to said body.

8. A reversible air-operated apparatus of the percussive type for driving holes in the ground by compacting the same, which is connected to a source of compressed air and incorporates a hollow cylindrical body tapered in the direction of driving the hole, comprising: a striker which divides the space in said body into at least one operating chamber and at least one exit chamber of variable volumes, said striker reciprocating due to the pressure of compressed air admitted into said apparatus, the striker striking against said body in the course of its travel, said striker being provided with at least one side port for admitting compressed air into said operating chamber and for allowing emission of spent air from this chamber, and said striker being provided with an interior space, the striker being left open at a rear end face; and air-distributing pipe which is connected to a compressed air line, said pipe being provided with at least one longitudinal passage communicating with the source of compressed air, and said pipe being disposed so that a forward portion of said pipe is contained in the space inside said striker, thereby placing said space in communication with the source of compressed air, a rear portion of said pipe being built into a rear part of said body of the apparatus with a provision for longitudinal travel relative to the body between foremost and rearmost positions of the pipe, the rear part of said body being provided with longitudinal passages which place said exit chamber in communication with a surrounding medium; a means of holding fast said pipe in its extreme positions relative to said body consisting of at least one member which exerts radial springy action, said member being of annular cross section, and said member being disposed so that the outward said surface of said member faces the inward side surface of said body and the inward side surface of said member faces a longitudinal axis of said apparatus, one of said surfaces of said springy member being exposed to the pressure of compressed air and the other to the pressure of the surrounding medium; a sleeve with holes in its walls which is interposed between said striker and the forward portion of said pipe, said sleeve being immovably attached to said body and being disposed in the space in said striker so that said pipe is contained inside said sleeve, the pipe closing the holes in said sleeve when said pipe is set into its foremost position and opening said holes when set into its rearmost position.

9. An apparatus as claimed in claim 8, wherein said member exerting radial springy action is made in the form of elastic rings and said pipe is provided with external grooves wherein said elastic rings are accomodated, said pipe being provided with through holes which place said grooves in communication with the longitudinal passage in said pipe.

10. An apparatus as claimed in claim 8, wherein said springy member is made in the form of an elastic cup attached to said body with its outward surface at one end and contacting the outward surface of said pipe at its rear portion with the inward surface of the remaining part, said body, said cup, the sleeve immovably attached to said body, and said pipe define a space which is in communication with the longitudinal passage in said pipe by means of a hole provided in said pipe; whereby said pipe is held fast in its extreme positions relative to said body by said cup when compressed air is admitted into said apparatus, in that said cup is pressed against said pipe.

* * * * *

UNITED STATES PATENT OFFICE

CERTIFICATE OF CORRECTION

PATENT NO. : 4,078,619

DATED : March 14, 1978

INVENTOR(S) : Boris Vasilievich Sudnishnikov, et al

It is certified that error appears in the above-identified patent and that said Letters Patent are hereby corrected as shown below:

On the front page, left-hand column, insert:

--[30] Foreign Application Priority Data

Oct. 1, 1975 U.S.S.R. .....2173251--

Signed and Sealed this

Sixth Day of March 1979

[SEAL]

*Attest:*

RUTH C. MASON
*Attesting Officer*

DONALD W. BANNER
*Commissioner of Patents and Trademarks*